US007235007B2

(12) United States Patent
Junker

(10) Patent No.: US 7,235,007 B2
(45) Date of Patent: Jun. 26, 2007

(54) DIVIDED GRINDING TOOL

(75) Inventor: Erwin Junker, Buehl/Baden (DE)

(73) Assignee: BSH Holice A.S., Holice (CZ)

( * ) Notice: Subject to any disclaimer, the term of this patent is extended or adjusted under 35 U.S.C. 154(b) by 0 days.

(21) Appl. No.: 10/579,451

(22) PCT Filed: Oct. 7, 2004

(86) PCT No.: PCT/EP2004/011216

§ 371 (c)(1),
(2), (4) Date: Jun. 12, 2006

(87) PCT Pub. No.: WO2005/046936

PCT Pub. Date: May 26, 2005

(65) Prior Publication Data

US 2007/0082592 A1 Apr. 12, 2007

(30) Foreign Application Priority Data

Nov. 12, 2003 (EP) ..... 03026039

(51) Int. Cl.
*B23F 21/03* (2006.01)
*B24B 55/02* (2006.01)

(52) U.S. Cl. ..... 451/541; 451/543; 451/449

(58) Field of Classification Search ..... 451/540–547, 451/449, 450

See application file for complete search history.

(56) References Cited

U.S. PATENT DOCUMENTS 2,712,205 A 7/1955 Valette
5,052,154 A * 10/1991 Lehmann ..... 451/542
5,259,150 A 11/1993 Himmelsbach
5,423,717 A * 6/1995 Boaz ..... 451/449
5,846,125 A 12/1998 Robichon

FOREIGN PATENT DOCUMENTS

| | | |
|---|---|---|
| DE | 290422 | 2/1916 |
| DE | 7406719 | 1/1975 |
| DE | 3322258 | 6/1984 |
| DE | 3405556 | 9/1985 |
| DE | 3728447 | 3/1989 |
| DE | 4115666 | 4/1992 |
| DE | 4103090 | 8/1992 |

* cited by examiner

*Primary Examiner*—Dung Van Nguyen
(74) *Attorney, Agent, or Firm*—Jordan and Hamburg LLP

(57) ABSTRACT

The invention relates to a grinding tool which comprises at least two detachable parts which are connected together. Both parts form a grinding disk-type body comprising a grinding surface which is interrupted on the peripheral area thereof. Said parts can be adjusted in relation to each other by means of an adjusting mechanism and can be fixed in the respective position thereof, such that the grinding disk-type body can be adjusted in relation to the grinding width thereof. Preferably, said adjustment takes place in a continuous manner. The grinding width can be adjusted in an advantageous manner for a variable grinding width which is to be ground and also for a readjusted grinding width which is to be ground in a plunge-grinding method.

10 Claims, 10 Drawing Sheets

DIVIDED GRINDING TOOL

BACKGROUND OF THE INVENTION

The invention relates to a grinding tool that comprises at least two parts.

Grinding tools in which a plurality of grinding wheels, in particular also grinding wheels with different thicknesses, are secured together into one grinding wheel packet are known for instance from DE 41 03 090 C1. Such grinding wheel packets are used in particular when contours are to be ground, whereby the contours are then put together using a corresponding packet that is adapted overall to the contour to be ground and that has corresponding partially profiled individual grinding wheels. The width to be ground can also be directly influenced by adding or removing individual grinding wheels from the grinding wheel packet. However, this is always associated with substantial equipment refitting complexity. If grinding is to be performed using such a grinding wheel packet for instance on a circumferential area and simultaneously on one or a plurality of planar shoulders, the problem occurs that the cutting volume from the grinding wheel on the sides of the packet with which planar grinding is conducted is substantially greater than for the circumferential grinding. This occurs because during circumferential grinding at least theoretically the grinding wheel has only a linear contact with the workpiece to be ground, while on the planar surfaces there is surface contact between the grinding wheel and the workpiece with a width equal to the amount at the planar shoulder due to the plunging process.

Due to the engagement of the grinding wheel with the planar surfaces, the wear on the grinding wheel in these areas as a rule is greater than on the circumferential area of the grinding wheel and/or a grinding wheel packet.

Compared to an individual grinding wheel, such a grinding wheel packet has the advantage that when there is rapidly occurring wear on the lateral wheels of the grinding wheel packet, only the latter have to be exchanged. However, this is associated with a high degree of refitting complexity and thus a substantially longer overall cycle period.

When grinding bearing bushes, for instance, which as a rule are ground using a plunge-grinding method, the actual bearing area, i.e. the circumferential area, is ground at the same time as the lateral shoulders and/or planar surfaces. Thus in the case of a grinding wheel that grinds such bearing areas, both the circumferential area and a lateral area of the grinding wheel are in contact with the surfaces to be ground. In this case, as well, the problem described in the foregoing occurs in that the lateral areas wear more rapidly than the circumferential surface. Although the grinding wheels can be dressed, normally such grinding wheels are not dressed on the planar side, but rather only on the circumference (see FIG. 8*a*: example of a lateral radius on the grinding wheel). However, if the normal dressing amount was also dressed on the sides, this would lead to a situation in which after dressing the tolerance width of a few μm or hundredths of a millimeter, which are required for the width of such bearing bushes, can no longer be maintained if this bearing bush is to be further manufactured using plunge-grinding. In the case of grinding wheels that have already been dressed, it is necessary to laterally offset the grinding wheel to the workpiece or vice versa so that both planar shoulders have to be ground separately, which means longer grinding time. On the other hand, if there is no dressing in the lateral areas, a shape error occurs with respect to the target contour of the grinding wheel.

In order to avoid these problems, during grinding of bearing bushes with planar shoulders using the plunge-grinding method it would be necessary to completely exchange a grinding wheel provided therefor with a grinding area in the circumferential area and with one or two grinding areas on its lateral surfaces more frequently in order to be able to attain the shortest possible grinding times.

However, the total costs for the grinding method are then highly impacted because of the relatively expensive grinding wheels.

In many grinding tasks today, grinding wheels with CBN, diamond, or comparable grinding means (hereinafter "CBN/DIA") layers are used. These CBN/DIA grinding wheels in fact do attain significantly longer service life than conventional grinding wheels. However, planar-side dressing required for these CBN/DIA grinding wheels also leads to a reduction in the width of the grinding wheel and thus in the width of the bearing bush deviating from the specified target value when the plunge-grinding method is used without laterally offsetting the grinding wheel or the workpiece. The grinding process is not an actual true plunge method when there is such a lateral relative movement between workpiece and tool. Instead, the planar shoulders are ground successively in the bearing area to be ground. This again results in substantially higher processing times and costs.

In contrast thereto, it is the object of the invention to create a grinding tool with which actual dimensional tolerances or changes in the width to be ground can be compensated or are possible without partially or completely exchanging the grinding tool. In particular, a grinding tool is to be created that grinds on a plurality of contact surfaces simultaneously, in particular using plunge-grinding, and with which processing-related wear, and thus associated actual tolerances in the width of the grinding tool that would otherwise occur, can be compensated.

SUMMARY OF THE INVENTION

In accordance with the invention, the grinding tool has at least two detachable parts that are connected to one another and that when connected to one another embody one grinding wheel-type body. This grinding wheel-type body has on its circumferential area a grinding surface that is embodied interrupted. The two parts that are detachably connected to one another can be positioned relative to one another using a positioning mechanism and can be fixed in the position such that the grinding wheel-type body is adjustable in terms of its grinding width.

The advantage of such an inventive grinding tool, the active grinding width of which is adjustable, is comprised in that the tool can be employed in a flexible manner for different grinding tasks, specifically without having to exchange the entire grinding tool or a part thereof for a changed grinding width. Such exchanging always requires additional time that has a negative effect on the total production time and that contributes overall to increasing costs.

The width adjustment can advantageously be performed such that for instance for a plunge-grinding process to be performed the grinding width can be moved up to a maximum of twice the thickness of the abrasive layer. Because the width can be adjusted, the inventive grinding tool can be dressed over the complete contour including the planar surfaces after width adjustment by a largely uniform measure, e.g. 10 μm. Because of this uniform dressing, first of all it is always possible to restore the geometrical accuracy of the grinding tool by dressing and to maintain the actual dimension between the planar shoulders. Secondly, after the dressing a grinding tool is obtained in which the grains are broken/comminuted/sharpened such that the cutting ability of the grinding tool is completely restored. In this manner it is avoided that the grains are smoothed on the planar grinding sides by the dressing.

Preferably the grinding with of the inventive grinding tool is continuously adjustable by means of the positioning mechanism. Because of this continuous adjustability of the width of the grinding tool, it can advantageously be attained that depending on the grain of the layer of the grinding tool, the optimal dressing size can be dressed across the entire grinding area, e.g. at all of the surfaces to be ground, so that after dressing a grinding wheel results that is precise in terms of the dimension and shape. Since with single-part grinding wheels in accordance with the prior art, dressing into the planar side is not possible, which is why the dressing area is only guided into the lateral areas around the radius of the circumferential surface to be ground, a relatively large amount of abrasive layer must be removed in order to maintain the final shape of the workpiece to be ground with a radius on the transitions to the planar surfaces every time the circumferential surface is dressed. In contrast, with the inventive grinding tool it is always possible to remove a uniformly small dressing amount during dressing so that one essential advantage of the inventive grinding tool is also comprised in that a much higher number of dressing cycles is possible for the grinding wheel so that the overall service life of the grinding wheel is substantially longer than that of conventional single-part grinding wheels.

Additional advantages of the inventive grinding tool are also comprised in that the inventory in processing is substantially reduced because for many tasks only a single grinding wheel has to be used that can be individually adapted to the grinding workpiece by adjusting the width to the grinding tasks. Moreover, advantages during machine grinding can also result in that while grinding is being performed with a width-adjustable grinding tool, a second, and only a second, grinding tool can be adjusted for another grinding task with another width. For the new grinding task, the grinding tool in the machine is then exchanged for the grinding tool that has just been adjusted. During grinding with the grinding tool that has just been adjusted there is then the option of adjusting the grinding tool that has just been removed from the grinding machine for another grinding process. Thus a great number of different grinding tasks can be undertaken with only two grinding tools without a great number of different grinding wheels being required.

Moreover, it is also possible to simultaneously grind a plurality of grinding sites, in particular bearing bushes, with the inventive grinding tool by chucking a plurality of such tools on one spindle.

Due to the preferably continuous adjustment of the width of the grinding tool, it is theoretically possible for positioning or readjustment to take place during each dressing, whereby the adjustability is a function of the accuracy of the adjustability of the positioning mechanism. Recalibrating the width of the grinding tool thus makes it possible to attain any possible configuration on a tool such as for instance a bearing shaft or crankshaft.

It is particularly advantageous when, in accordance with one preferred further embodiment of the invention, in addition to the grinding area embodied interrupted on the circumferential area, the grinding wheel-type body, i.e. the inventive grinding tool, is provided with a grinding surface on at least one, however preferably on both, of its exterior lateral surfaces. Such a grinding surface can be provided for instance in that an abrasive layer is applied to the circumferential side of the grinding tool and is conducted around the exterior edges of the circumferential area at least partially into the lateral surfaces. For grinding bearing bushes with planar shoulders, the grinding process is a plunge-grinding process, thus at three grinding areas simultaneously, specifically the actual bearing bush and the two planar sides that limit the bearing surface laterally.

With such a grinding tool that has at least two grinding surfaces (on the circumferential area and on another lateral area) or with a grinding tool that even has three grinding surfaces, specifically on the circumferential area and on both outer lateral surfaces, it is possible advantageously for instance during plunge-grinding to grind a circumferential area and a planar shoulder in the case of two grinding surfaces on the grinding tool or for instance for a bearing bush to grind a circumferential area and two planar surfaces that are distanced from one another. In such a case, due to the ability to adapt the width of the grinding tool, it is possible to readjust the grinding tool by the amount that is required to compensate the grinding wheel wear from the grinding operations for dressing.

The two parts of the grinding tool preferably have grinding means in the form of a CBN/DIA layer, whereby the two parts of the grinding tool are coated either completely or partially or by area with an abrasive layer.

Preferably the two parts that form the grinding wheel-type body have shape-congruent teeth on their inner sides, i.e. their axial sides that face one another, and that are called planar teeth. In order for instance to be able to compensate a wear-related reduction in the width dimension of the grinding tool or to be able to change a certain width to be ground, in the inventive grinding tool the two parts that are detachably connected to one another can be positioned relative to one another, this changing the possible grinding width to be ground using the grinding tool. In order to be able to assure reliable positioning, the two parts are guided relative to one another such that they remain centered to one another and simultaneously prevent a movement relative to one another that is to be avoided during the grinding process. Provided for this is preferably a cylindrical guide outside of the adjusting/positioning units, whereby forces occurring relative to this are assumed by setscrew-related pressing forces.

The teeth that engage the two parts that form the divided grinding wheel-type body furthermore have surfaces that are preferably arranged in planes that run largely perpendicular to the rotational axis of the grinding tool. This means that these surfaces form edges that extend in the circumferential direction on the grinding tool for a certain distance, but not across the entire circumference. It is preferred when these surfaces of the teeth are arranged in planes that are inclined to the rotational axis of the grinding tool. In such a case, these separating edges that represent the division of the grinding tool seen from a top view of the circumferential surface of the grinding tool are inclined to the circumferential direction, without however reaching from one lateral edge of the grinding tool to its opposing outer edge located in the other part. Such separating edges arranged on an incline assure that during the grinding process the free gap between the two grinding wheel parts, i.e. the separation joint, at which there are no abrasive grains, is minimized with respect to its extension to the circumference. Due to the inclined arrangement of these edges on the separating joints, their distance from one another in the circumferential direction is relatively small so that the grains located on the edge during the grinding process, at the moment at which they are again involved in the grinding process, only have to assume slightly increased loads in comparison to the other grains.

Regardless of whether these separating edges of the two parts run in the circumferential direction or inclined thereto, in accordance with one preferred further development of the inventive grinding tool, the separating edge is, or the separating edges of the two parts of the grinding tool that are embodied shape-congruent to one another are, provided with alternating overlapping elements of this circumferential line relative to an imaginary circumferential line in the circumferential area. Alternating overlapping elements shall be construed to mean that relative to this circumferential line each of the parts of the grinding tool has an area in which the teeth overlap this imaginary circumferential line, followed by an area in which the circumferential line is underlapped. I.e., the teeth extend largely across the entire radial extension of the planar surfaces of the grinding tool to its outer circumference. In the area in which the one part underlaps the circumferential line, the other part has correspondingly embodied overlapping teeth that are embodied shape-congruent with the underlapping element. In this manner it is assured that, when positioning the two parts of the grinding tool relative to one another for attaining a larger width up to approximately 175% of the original, smallest possible width that can be used for grinding with the grinding tool, when grinding, grinding means are always in contact with the surface to be ground across the entire width, specifically even in the areas in which the actual separating joint is embodied. Because the separating joint runs by segment in a plane perpendicular to the rotational axis of the grinding tool.

Preferably the shape of the teeth embodying the overlapping elements on the exterior circumference are embodied in a step shape, trapezoidal shape, saw-tooth shape, pointed, or a combination thereof with respect to the imaginary circumferential line. In another preferred embodiment, the teeth are embodied in a wave shape, whereby different waveshapes are possible. Care must only be taken that the two parts that are connected together to form the grinding tool are themselves reliably centered and attached during or after their positioning relative to one another.

In accordance with one preferred embodiment of the grinding tool, when the grinding wheel-type body is preferably embodied as a divided grinding wheel and when this grinding wheel has grinding areas both on the circumferential area and on its two lateral areas, due to the adjustability a desired width to be ground can be ground in a plunge-grinding process. The higher wear on the planar surfaces that leads to falling short of a specified target amount can be adjusted or compensated so that the inventive grinding tool can again be used while maintaining the required longitudinal dimension for instance between the planar shoulders of such a bearing bush. A longer tool service life with the same grinding time can be attained in this manner with such a divided grinding tool. The tool costs for the grinding process can thus be significantly reduced. The latter is especially true because CBN/DIA-fitted grinding wheels always represent another significant cost factor.

In the inventive grinding tool, preferably the positioning mechanism for adjusting and fixing the two parts relative to one another has at least three adjusting/positioning units that are arranged circumferentially on the grinding tool on its one side spaced at largely the same angle. Preferably one of the two parts that embody the grinding tool is arranged securely on a drive spindle, in contrast to which the second part, on which the adjusting/positioning units are arranged, is positionably and/or displaceably affixed relative to the part mounted securely on the spindle. For securing a positionally fixed position of the one of the two parts that is movable relative to the position of the one of the two parts that is fixed, a centering device is preferably provided, in particular a centering collar, by means of which reliable centering of both parts of the grinding tool relative to one another is assured in each width adjustment position. Moreover, centering of the inventive grinding tool is required on the spindle nose. This can occur using different systems that are already known. For instance the centering can occur using a cone, three-point arbor in accordance with DE33 22 258 A1 and/or DE 34 05 556 or a bore with a "narrow" passage.

The adjusting/positioning units are preferably arranged as far as possible outside in the direction of the exterior circumference of the inventive grinding tool so that the two grinding wheel parts are prevented from spreading during adjusting of the grinding width to be ground and while the two grinding wheel parts are secured after an adjustment. If certain minor deviations in the concentricity properties of the two grinding wheel parts still occur during securing, these are reliably compensated by a dressing process that is performed after each adjustment. Thus, dressing not only produces a grinding wheel with good cutting capability, as is in general usual and known, but also produces the most ideal possible dimensional and concentricity properties after adjustment and securing of the two grinding wheel parts relative to one another so that after a positioning and subsequent dressing the inventive width-adjustable, i.e. divided, grinding tool behaves largely precisely like an undivided grinding wheel in terms of its grinding properties.

In clamping devices that preferably act with a nonpositive fit and that after the adjustment of the width to be ground fix the relative position of the two grinding wheel parts to one another, the teeth are preferably arranged with respect to one another such that they do not touch one another with their lateral surfaces that run largely radially. However, it is also possible that on some of the lateral surfaces of the teeth the opposing teeth are placed against one another. In any case, the nonpositive fit connection of the two grinding wheel parts is designed such that reliable torque transmission is possible without movement being possible relative to one another and or counter to the direction of rotation. Another advantage of nonpositive fit-securing of the two grinding wheel parts to one another is comprised in that the manufacturing precision of the teeth can be relatively small since they do not form any guide surfaces for the parts in their positioning relative to one another and also do not contribute to the torque transmission.

In accordance with a first exemplary embodiment, the positioning mechanism is and/or the adjusting/positioning units are mechanically manually actuatable. The mechanical design and manual adjustability has the advantage that the structure of the positioning mechanism is thus relatively simple and cost-effective. However, it is also possible for the adjusting/positioning units to be automatically actuatable. In such a case, the grinding tool increases in complexity and thus in cost. However, automatic actuation offers significant advantages for compensating wear-related grinding width deviations in the grinding tool during ancillary times in processing. The grinding wheel is not actively grinding in these ancillary times.

Automatic actuation of the adjusting/positioning units has substantial advantages for complex automation of the grinding process.

For this, preferably measurement sensors are present that permanently monitor the width to be ground on the workpiece and generate a signal in this regard that is recordable and that can be evaluated. The width for the width-adjustable grinding tool is then recalibrated and occurs based on what has been recorded. In particular for a plunge-grinding process, in which grinding surfaces are also present on the outer lateral surfaces, there is an improvement in the accuracy of the workpiece as well as the service life and usability of such an inventive grinding tool.

Preferably provided both for automatic actuation and also for mechanical manual actuation of the adjusting/positioning units is a scale that can be used to read how far apart the two parts that form the grinding tool are positioned from one another. With such a width-adjustable grinding wheel there is thus a possibility for obtaining uniformly high quality, in particular of bearing bushes to be ground in the plunge-grinding process, with high flexibility and moderate costs.

Based on the fact that the teeth do not have any guide function for one another in their radially embodied planes and the two grinding wheel parts are embodied such that in their relative positioning to one another intermediate spaces are still formed in the interior between the two grinding wheel parts in the smallest possible width of the grinding tool, present in the interior of the divided grinding wheel tool are channels that run largely from the area of attachment of the grinding tool at the spindle to immediately in the grinding area on the abrasive layer. Coolant is preferably conducted directly into the immediate grinding area through these intermediate spaces or channels. This can occur in that in the area of the clamping of the grinding tool coolant is initially introduced into the inventive grinding tool preferably under pressure in the axial direction and is diverted in the interior into the intermediate spaces and there is either conducted under pressure or by the centrifugal force caused by the rotation of the grinding tool or even due to both effects in the interior of the divided grinding tool in the direction of the outer circumference and thus directly to the immediate grinding area. Centering of the two grinding wheel parts that is for centered orientation of the two grinding wheel parts relative to one another, is preferably circumferential and only step-wise on a collar so that sufficiently large channels and/or intermediate spaces result for transporting the coolant in the interior of the inventive grinding tool.

BRIEF DESCRIPTION OF THE DRAWINGS

Additional advantages and application options of the invention shall now be explained in greater detail using a detailed description of exemplary embodiments.

DETAILED DESCRIPTION OF THE INVENTION

Figure 1:
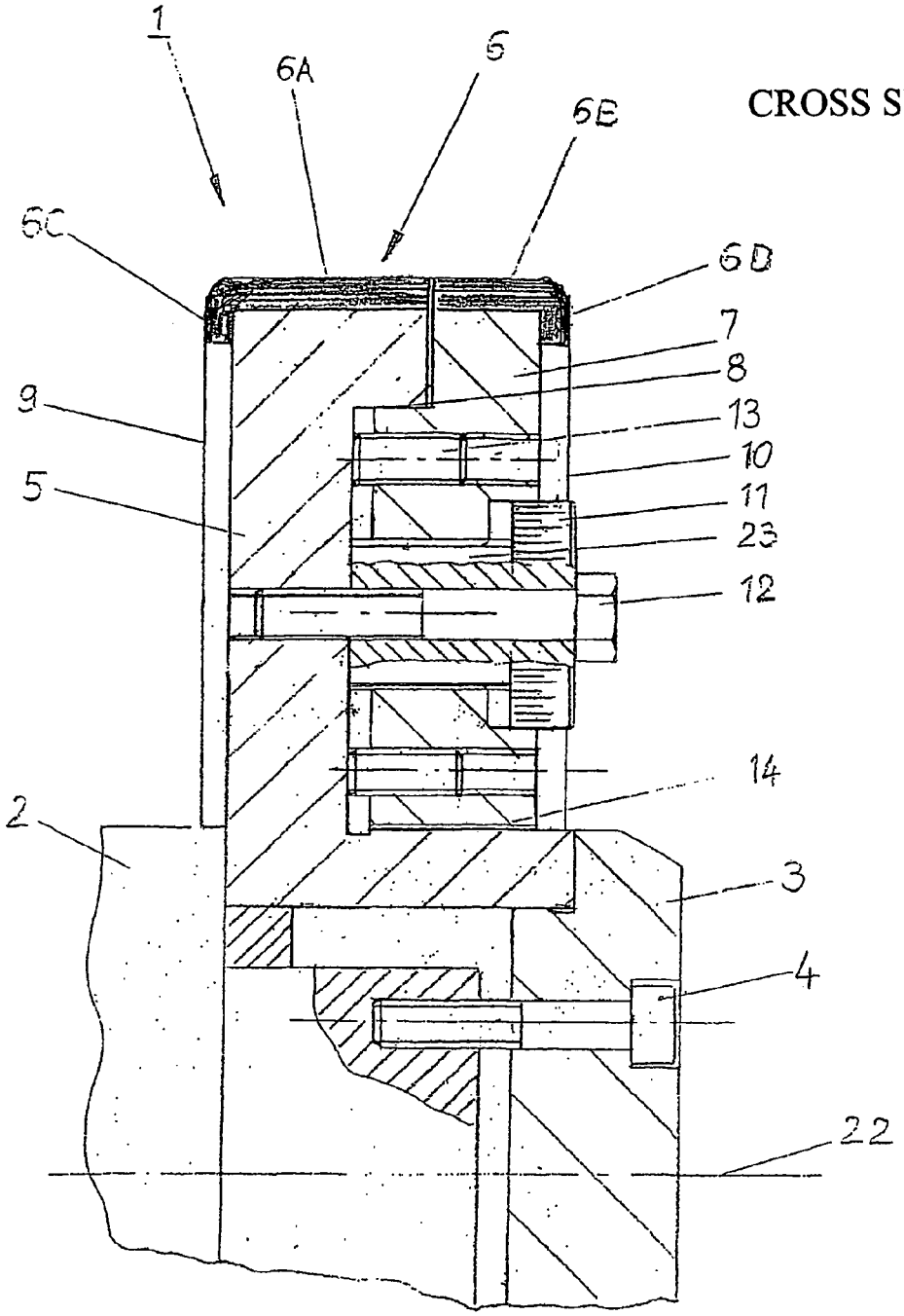
FIG. 1 depicts a section of an inventive grinding tool in accordance with a first exemplary embodiment according to a sectioning line A—A in FIG. 2.

FIG. 1 depicts a semi-sectional view of the inventive grinding tool 1 in accordance with a first exemplary embodiment of the invention. Provided in a manner known per se as the drive for the inventive grinding tool 1 in the form of a divided grinding tool is a rotationally driven grinding spindle 2, and at its one end, which is also known as the spindle nose, a first part 5, also known as the base body, is attached and positionally fixed. This part 5 is likewise positionally fixed in a manner known per se by means of a mounting flange. Such a mounting flange 3 secures non-positive fit positional fixation of the part 5 on the grinding spindle 2 via a plurality of tensioning bolts 4 arranged distributed circumferentially. The inventive grinding tool 1 has an additional part 7 that is embodied as a displaceable body and that can be positioned with respect to the part 5 by means of a positioning mechanism such that the active grinding width that can be attained with the inventive grinding tool is adjustable.

Both the part 5 and also the part 7 have a CBN abrasive layer 6 on their circumferential direction. Both outwardly facing lateral surfaces 9, 10 of the inventive grinding body, i.e. in FIG. 1 the left-hand lateral surface 9 of the part 5 fixed on the spindle 2 and the right-hand side 10 of the part 7 that is movable relative thereto, are likewise provided with such an abrasive layer. Due to the division of the grinding tool in the direction of the width, grinding areas 6A and 6B of the two parts 5 and 7 are provided in the circumferential direction, and grinding areas 6C and 6D of the two parts 5 and 7 are provided in the lateral surfaces 9, 10. The part 7 is provided by means of three adjusting/positioning units 11, 23 that are arranged spaced apart from one another in the circumferential direction at the same angle, preferably 120°, relative to a setscrew 23. In this exemplary embodiment, the adjusting/positioning units 11, 23 can be mechanically positioned by means of a setscrew 23. By positioning the setscrew 23 and thus the scale 11, the width with which the inventive grinding tool can plunge-grind for instance a bearing bush can be adapted to the current requirements.

The part 7 is centered on an external centering shoulder 8, also known as a centering collar, such that the grinding surfaces 6A and 6B are always arranged on the circumferential side of the grinding tool at the same circumferential level. This guide centering, which is radially as far to the outside as possible, is realized via a clearance of a few micrometers via which good concentricity properties can be attained for the inventive grinding tool rotating at high speeds in the grinding process. Due to the relatively high centrifugal forces of the rotating grinding tool, this outer centering shoulder 8 is arranged outside of the adjusting/positioning units 11, 23. With such exteriorly located centering, clearance of for instance 0.3 mm is provided on the interiorly located collar, i.e. the inner centering collar 14. However, it is also possible to perform the centering on the inner centering shoulder 14, in which case corresponding clearance is provided at the outer centering shoulder 8.

The setscrews 23 of the adjusting/positioning units 11, 23 are each supported on an abutting surface or planar surface 24 of the part 5 of the grinding tool. In order on the one hand to attain a precise adjustment of the at least three adjusting/positioning units 11, 23 and on the other hand to be able to precisely adjust the grinding width to be ground or reset, the setscrew 23 is provided with a scale 11. For adjusting each of the adjusting/positioning units to the same scale value in order to set the grinding wheel to the desired width and thus to ensure that the grinding tool remains centered and balanced in terms of mass each time it is positioned, the setscrew 23 is adjusted. For instance during plunge-grinding, if after repeated grinding of bearing bushes the grinding surfaces 6C and 6D have experienced wear that is outside of the grinding tolerance, the width of the grinding tool can be reset by resetting the setscrew 23 by a specific scale value on the scale 11. This renders the grinding tool fully usable for further grinding operations without having to use a new grinding wheel or having to exchange parts, whereby as a rule dressing is performed subsequently. The part 7 is secured on the grinding tool relative to the part 5 by tightening a tensioning bolt 12 that is located in the interior of the setscrew 23 on the same center axis.

Threaded tensioning pins 13 ensure that the part 7 of the grinding tool that is arranged positionable relative to the part 5, specifically in the direction of the rotational axis 22, is pressed radially outward on the flank of the thread of the setscrew 23 after the tensioning bolt 12 has been tightened. This ensures that the part 7 is secured to the part 5 in a nonpositive fit and with no play (see also FIG. 3 and associated description).

Figure 2:
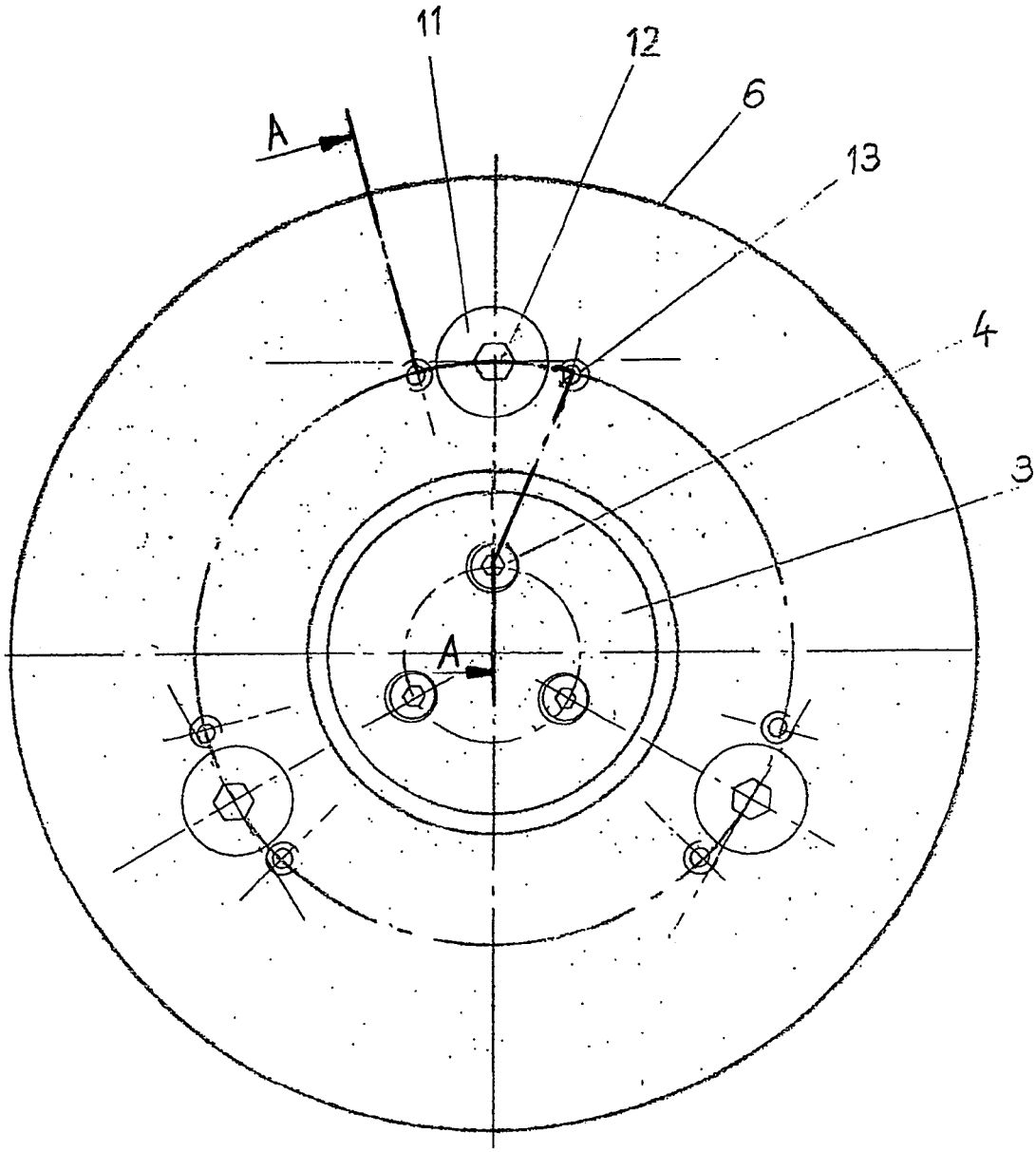
FIG. 2 depicts a side view of the grinding tool in accordance with FIG. 1, looking at the adjusting/positioning units.

FIG. 2 depicts a side view of the inventive grinding tool from the side of the part 7 onto the adjusting/positioning units 11, 23. The section line A—A that is the basis for the sectional view in FIG. 1 is drawn in. Arranged around the circumference at angles of 120° are three adjusting/positioning units 11, 23 that have in their interior a tensioning bolt for positionally fixing the adjusted width of the inventive grinding tool. Located on the same circumferential line are threaded tensioning pins 13 that eliminate the play in the thread that is present in the adjusting screw 23 relative to the part 7. I.e. freedom from play is ultimately attained in the threads of the adjusting/positioning units by means of the threaded tensioning pins 13. Likewise illustrated on the circumference in the interior area of the side view, spaced apart at angles of 120°, are three tensioning bolts 4 which enable the mounting flange 3 to accommodate the inventive grinding wheel tool on the spindle 2. However, it is also possible to provide more than three tensioning bolts circumferentially at a distance from one another at the same angle.

Figure 3:
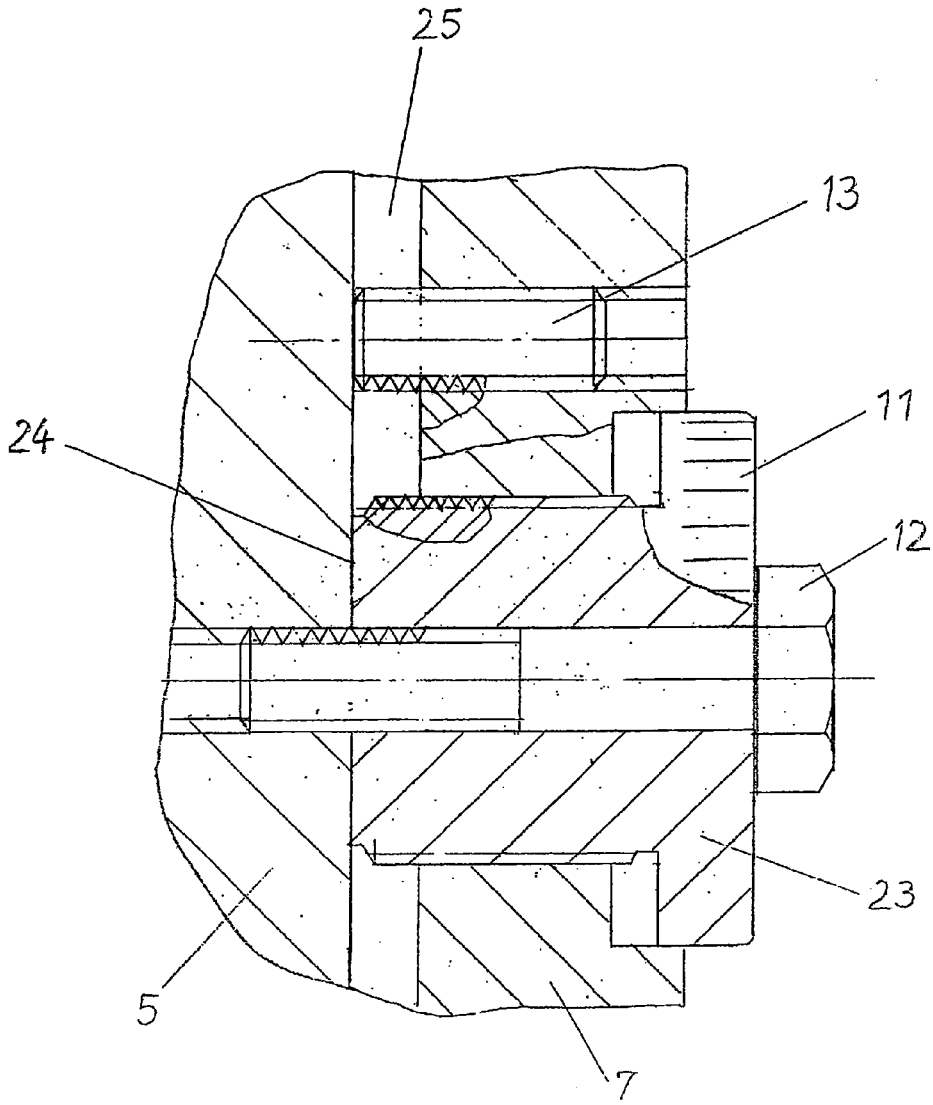
FIG. 3 depicts a partial section of a nonpositive-fit adjusting/positioning device that is clamped (positionally fixed)

FIG. 3 depicts an enlarged partial sectional view of the adjusting/positioning unit. The distance between the grinding wheel parts 5 and 7 that can be moved relative to one another is adjusted by means of the setscrew 23. In order to attain fine adjustments, the adjusting thread is embodied as a fine thread with small turns so that very precise adjustment of the grinding wheel width is possible. These threads are at least turned or ground. Provided at the setscrew 23 is a scale 11 that can be used to precisely read the actually adjusted width of the grinding wheel. In order to effect a displacement of the grinding wheel parts 7 and 5 relative to one another, the setscrew 23 is supported on an abutting surface 24 (not shown in FIG. 3). I.e., the distance between the two parts 7 and 5, and thus the grinding wheel width, is adjustably regulated by turning the setscrew 23. The selected positioning of the grinding wheel parts 7 and 5 relative to one another is fixed by means of the setscrew 12 to the precise desired grinding wheel width such that a nonpositive fit connection results between the setscrew 23 and the abutting surface 14. Torque is transmitted to the movable grinding wheel part 7 via this nonpositive fit connection. So that the flank clearance present in the fine threading of the setscrew 23 is completely released, the additionally present threaded tensioning pins 13 are then tightened, and these are also supported on the abutting surface 24. Thus tightening these threaded tensioning pins 13 also eliminates the play in all of the threads in the adjusting/positioning mechanism 11, 23.

So that there is uniform tension in the individual adjusting/positioning units around the circumference, all of the tensioning elements 12, 13 are tightened by means of precisely adjustable torque moment keys such that overall largely the same pressing force by the tensioning elements and/or setscrew is present on the abutting surface 24. This attains uniform positional fixation of the two grinding wheel parts 5, 7 relative to one another across the circumference of the inventive grinding tool. Embodied between the two grinding wheel parts 7 and 5 in the interior is an intermediate space 25 through which coolant can be conducted into the immediate grinding area (see FIG. 10).

Figure 4:
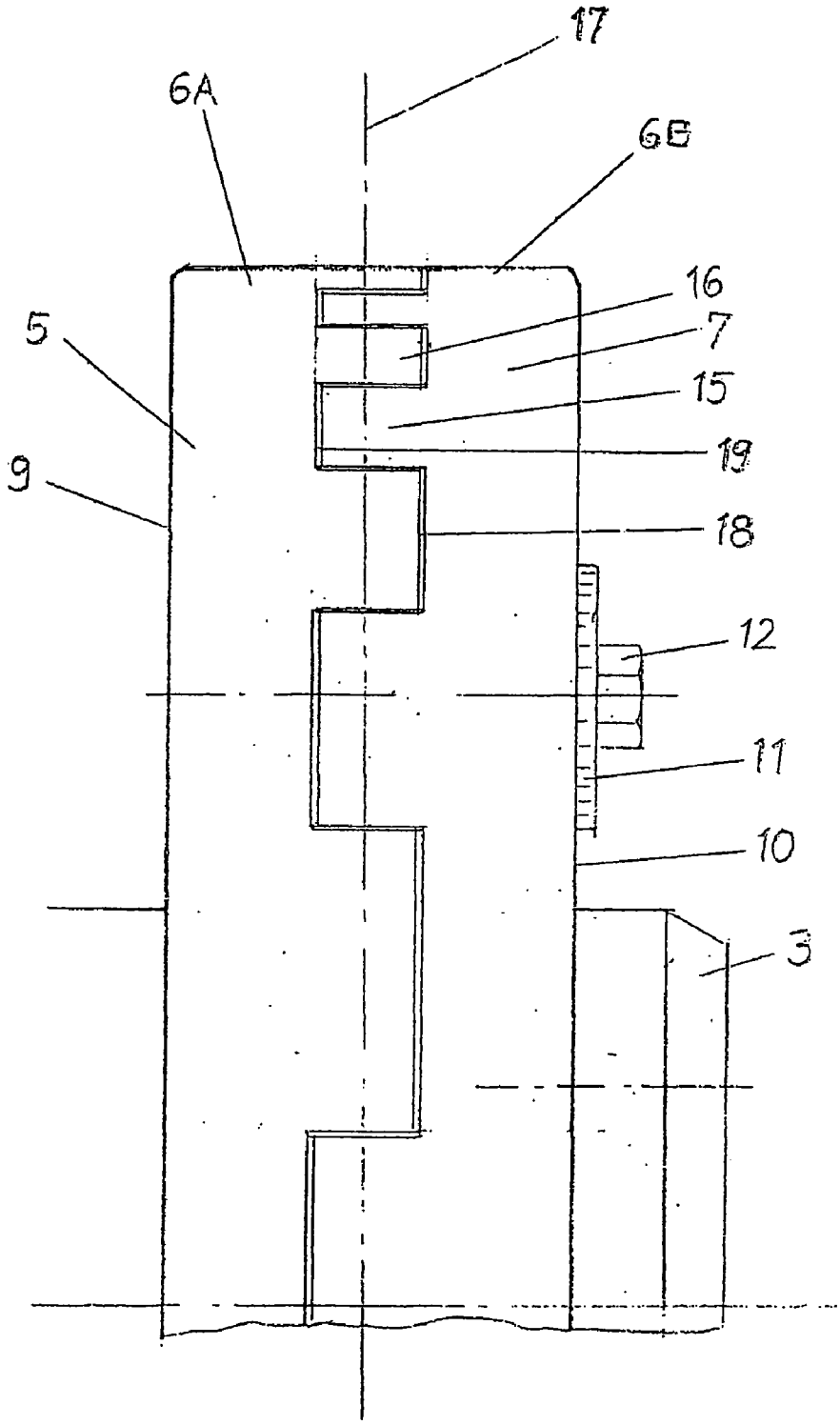
FIG. 4 depicts the exemplary embodiment in accordance with FIG. 1 looking at the circumferential area of the inventive grinding tool.

FIG. 4 provides a top view of the circumferential area of the inventive grinding tool in which the part 7 and the part 5 form a unified grinding tool using teeth that engage in one another. With regard to the imaginary circumferential line 17, the parts 5 and/or 7 overlap this imaginary circumferential line 17 with overlapping elements 15, 16 in areas where the one of the two parts 5, 7 has an overlap relative to the imaginary line 17 and the other of the two parts 5, 7 has a corresponding underlap. The teeth are embodied such that they fit one another with congruent shapes.

In the exemplary embodiment in accordance with FIG. 4, embodied on the separating edges that run in a plane perpendicular to the rotational axis 22 are surfaces 18, 19 that run in the circumferential direction. During grinding operations, the abrasive grains that are disposed on the front edge in the grinding direction are loaded relatively heavily because there is no abrasive layer present along the separating joint when the parts 5, 7 are correspondingly apart from one another. However, the abrasive layer is present in the adjacent overlaps so that it is assured that grinding means are in contact across the entire width to be ground in the grinding process.

Figure 5:
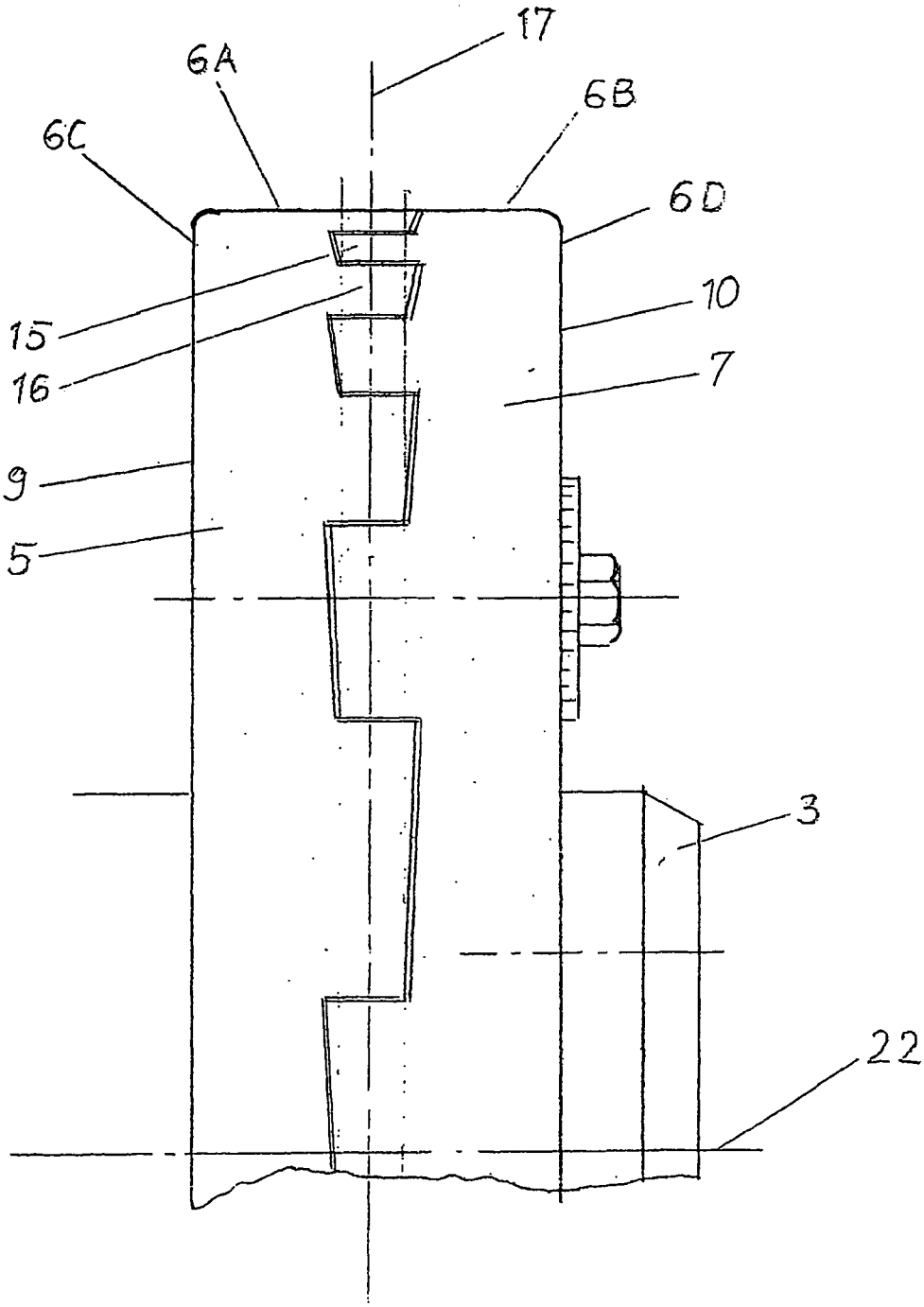
FIG. 5 depicts another exemplary embodiment looking at the circumferential area of the inventive grinding tool with separating joints for the teeth, the joints running on an incline.

FIG. 5 depicts another exemplary embodiment in accordance with the invention in which the separating joints that are embodied at the surfaces 20, 21 of the teeth run in planes that are arranged inclined to an axis perpendicular to the rotational axis 22. With such inclined separating joints, it is assured that the abrasive grains arranged on the front edge in the direction of rotation are only moderately loaded because thus during the grinding process other abrasive grains that are disposed successively thereafter are always in contact.

Figure 6:
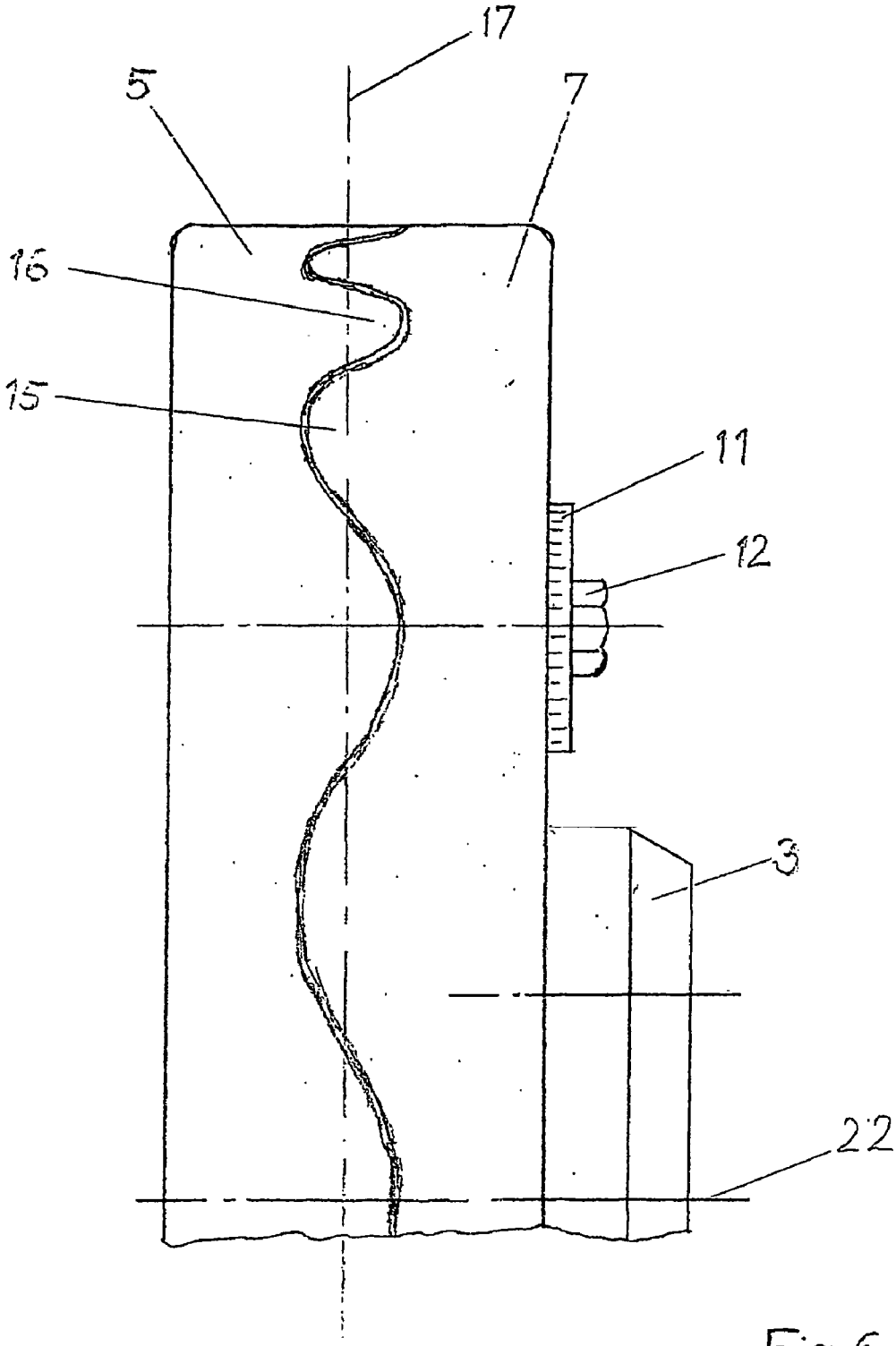
FIG. 6 depicts another exemplary embodiment looking at the circumferential area of the inventive grinding tool with a wave-shaped separating joint.

FIG. 6 depicts another exemplary embodiment of the inventive grinding tool in which the separating joints between the parts 7 and 5 are embodied in waveshapes. Reference numbers are identical to those in FIGS. 4 and 5.

Figure 7:
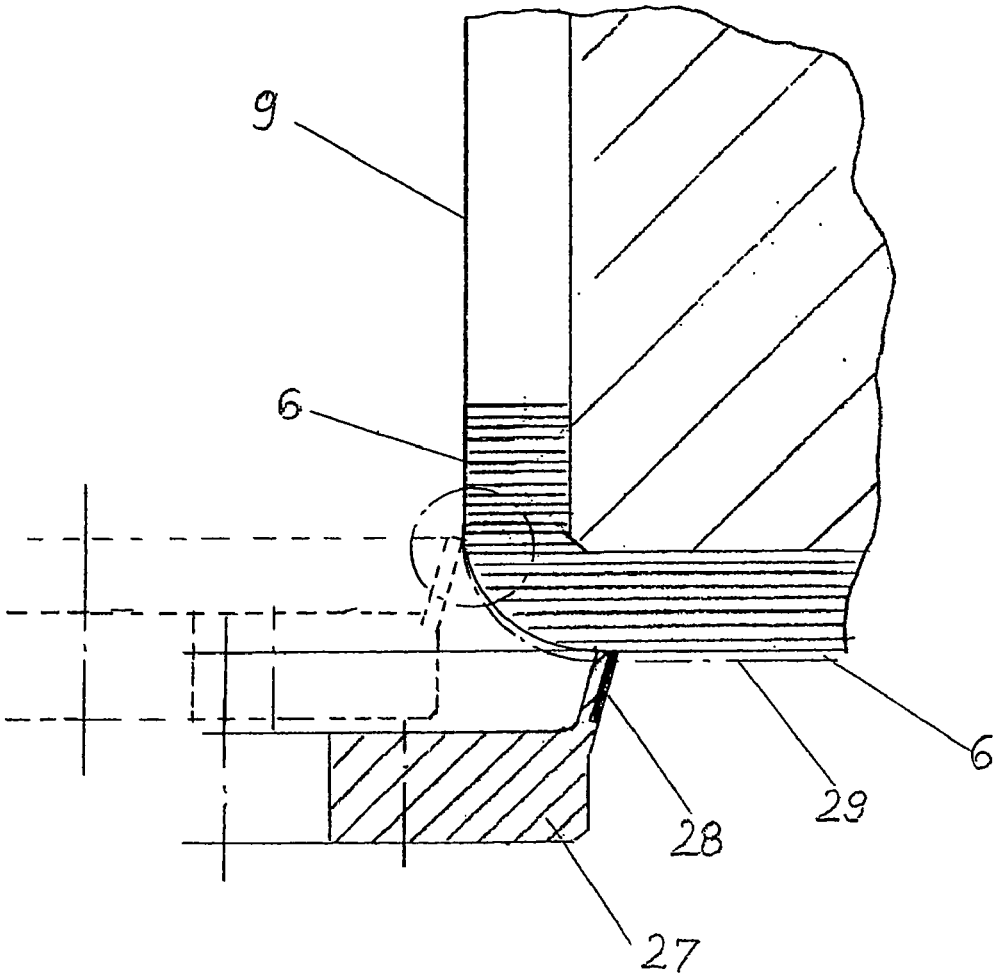
FIG. 7 is a schematic depiction of the dressing process for a conventional single-part grinding wheel with a cup-shaped dressing wheel.

FIG. 7 illustrates the principle during dressing of a grinding wheel that cannot be reset in terms of width in accordance with the prior art by means of a cup-shaped dressing wheel 27 with a diamond layer 28. This grinding wheel has an abrasive layer 6 that is arranged both on the end face and in a partial area of the lateral surface 9. For grinding bearing bushes using plunge-grinding, the width of this grinding wheel is exactly the same as the distance between the planar shoulders on the bearing bush. Therefore it is not possible to dress the abrasive layer 6 on the lateral surface 9. Dressing would lead to situation in which the linear dimension between the planar shoulders of a bearing bush could no longer be attained. Therefore in such grinding wheels dressing is largely performed only on the circumferential side. The broken line 29 represents the contour of the grinding wheel prior to the dressing process. During dressing, the amount between the original contour 29 and the contour after dressing is removed. A dressing depth must be produced such that the grains after dressing, in addition to producing the most ideal possible concentricity properties for the grinding wheel, are resharpened, but not smoothed. This restores good cutting capability for the grinding wheel. FIG. 7 furthermore illustrates that the dressing wheel 27 with the diamond layer 28 is guided around the radius in the transition area from the circumferential area to the lateral area of the grinding wheel. For maintaining the width of the single-part grinding wheel, however, the dressing amount extends to the end of the radius of the grinding wheel to 0. The smaller the dressing amount, the more deviation there is in this area from the goal of breaking the grains in order to attain a grinding wheel with good cutting capability and a smoothing of the surface occurs. However, during plunge-grinding it is precisely this area of transition of the radius to the lateral surfaces that must have the greatest grinding performance on the planar shoulders of the bearing surface. In contrast to the circumferential grinding area in which there is line-shaped contact with the workpiece to be ground, there is surface contact in the area of the plunging of the transition areas to the side 9 or 10 of the grinding wheel (see FIG. 9). All of the grinding work is to be performed only by the front abrasive grains; the abrasive grains disposed thereafter immediately in the lateral surface do not contribute or contribute only minimally to the actual grinding process. So that the complete width of the grinding wheel can be maintained, the dressing amount does not extend around the radius by a complete 90° in the direction of the lateral surfaces, but rather reaches the value 0 at an angle of for instance 87°. Thus the lateral flank is not dressed.

Figure 8:
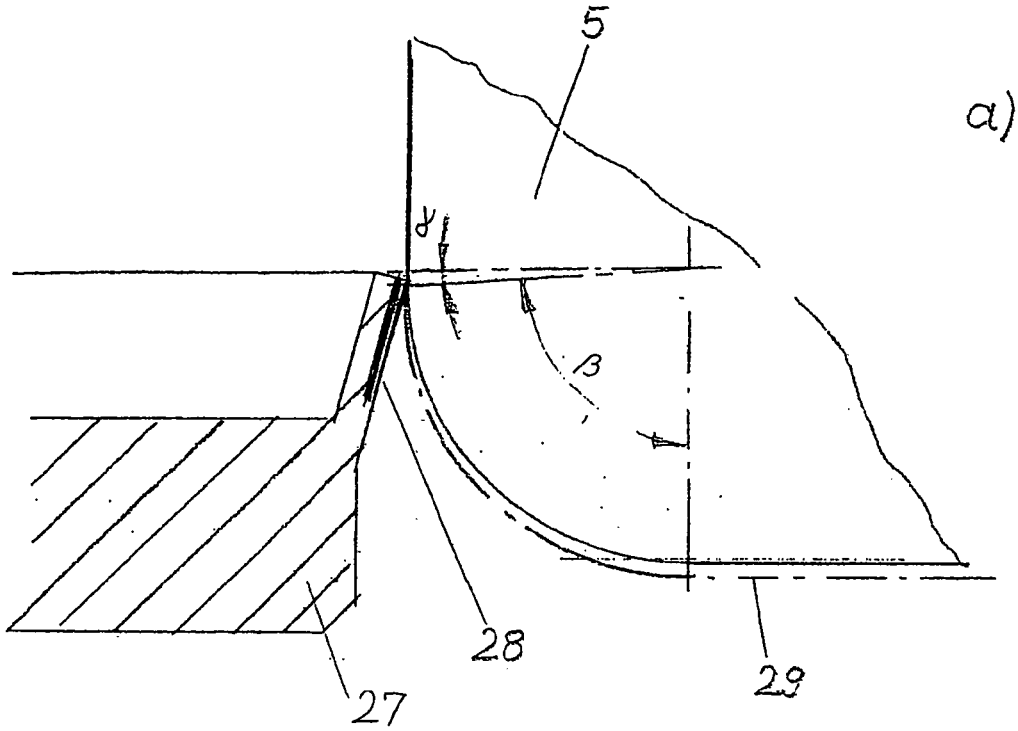
FIG. 8*a*) depicts an enlargement of the dressing conditions in accordance with FIG. 7.
FIG. 8*b*) depicts the dressing conditions for a width-adjustable inventive grinding tool using the same scale as FIG. 8*a*)
Figure 8:
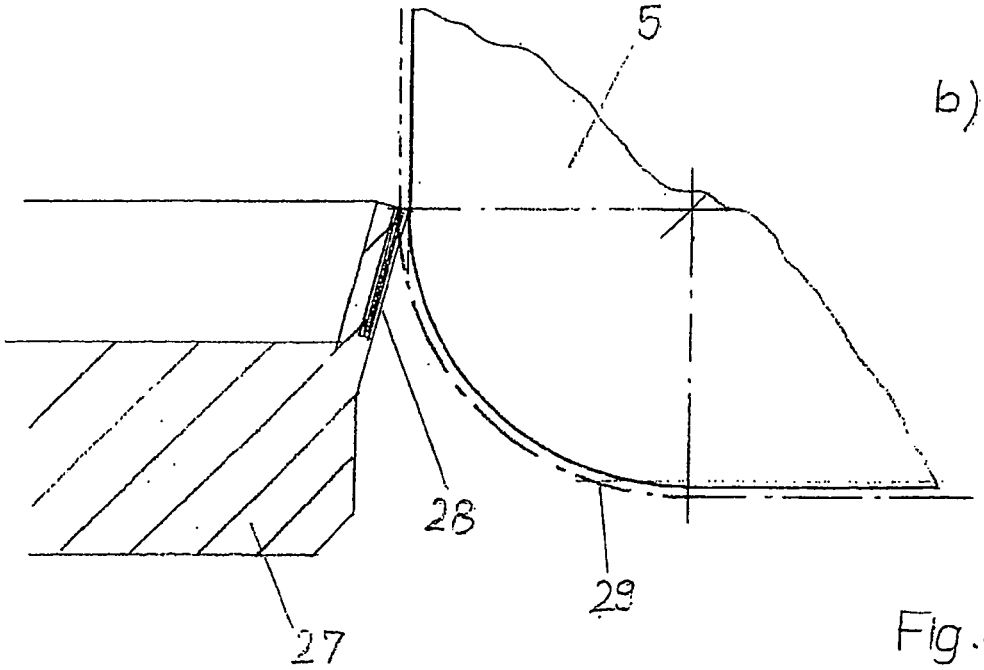

This is illustrated again in enlarged detail in FIG. 8*a*). The angle $\alpha$, for instance 3° (complementary angle to angle $\beta$) indicates the point at which the dressing amount 29 is reduced to zero in the outer radius transition of the grinding wheel. However, in order to be able to maintain the shape relationships on the radius transition of the bearing bush in relation to the planar shoulders, a relatively large amount of grinding means must be removed during dressing in the circumferential area when using a single-part grinding wheel. Otherwise the profile would "collapse".

The situation is different when dressing an inventive grinding wheel. This is illustrated in FIG. 8*b*). It can be seen that the dressing wheel 27 is conducted around the entire contour of the grinding wheel to be dressed from the circumferential area across the radius area and finally into the lateral area and a uniform dressing amount is removed. Because with the inventive grinding wheel the amount removed during dressing can be compensated by the width adjustment. Thus it is possible to remove only as much grinding means during dressing as needed for the grinding wheel to again have good cutting capability; smoothing it can be prevented in all of the grinding areas of the grinding wheel. Given that during dressing only the minimum amount for it is to be removed, the inventive grinding wheel can be dressed much more frequently before the grinding wheel layer of the grinding wheel has been largely completely used up and the grinding wheel has become unusable.

Figure 9:
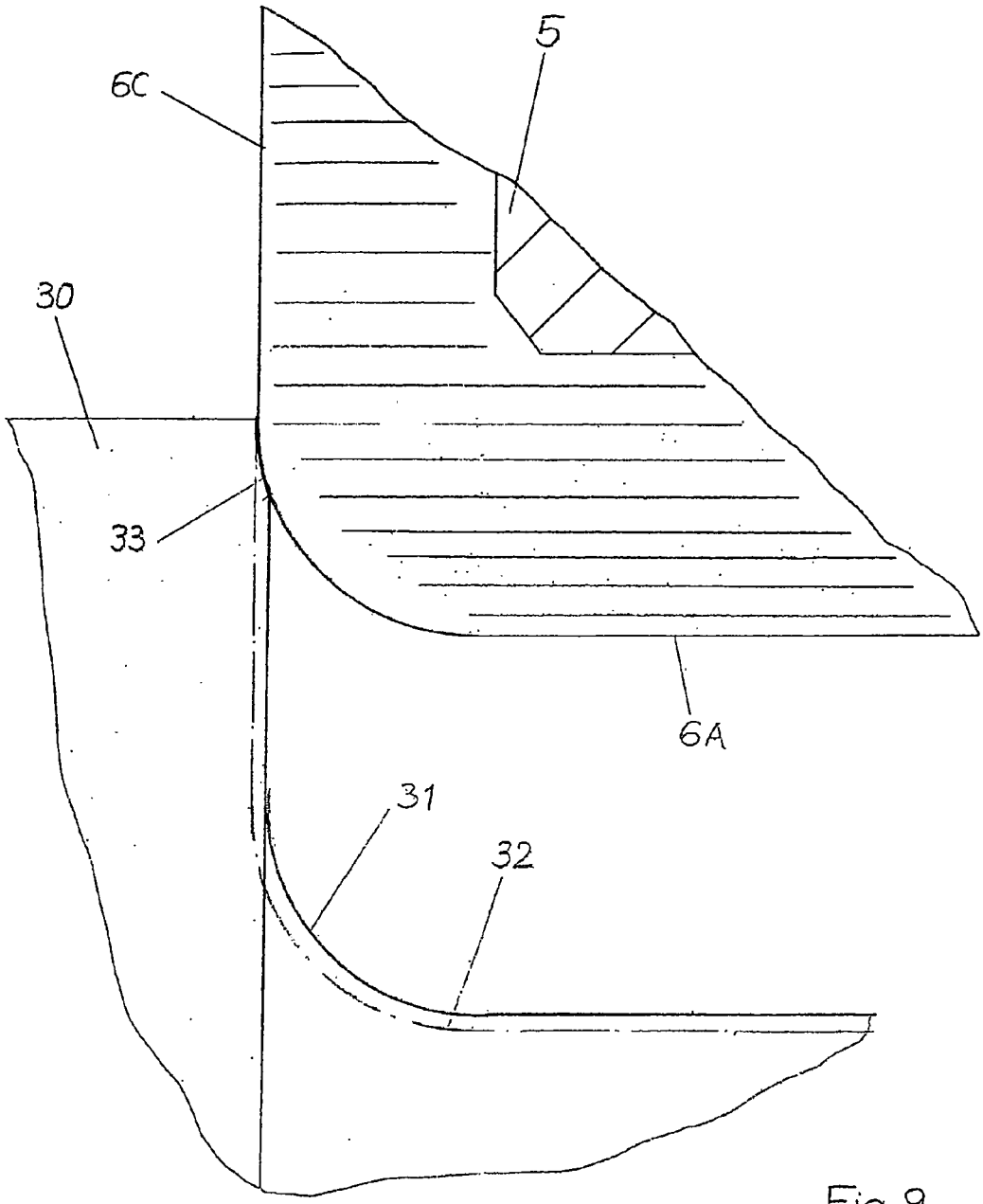
FIG. 9 depicts the principle for the contact conditions during a plunge-grinding process on a planar shoulder; and, FIG. 10 depicts an exemplary embodiment similar to that in accordance with FIG. 1 in which coolant is conducted via interior channels between the two grinding wheel parts to the immediate grinding area.

FIG. 9 illustrates an enlargement of an inventive grinding tool. It depicts the grinding relationships at the moment at which the grinding tool is just beginning to grind the planar shoulder using plunge-grinding with its grinding surface/lateral surface 6C in the planar shoulder area of the workpiece 30 to be ground. Only the part 5 of the grinding tool with its abrasive layer 6A in the circumferential area and 6C in the lateral area of the outer lateral surface 9 of the grinding wheel-like body is illustrated. Furthermore illustrated is the raw contour 31 of the workpiece 30 that is ground by means of the inventive grinding tool to the workpiece final contour 32, which is shown with the broken line. When such a bearing bush with opposing planar shoulders is ground, as illustrated in FIG. 9 this occurs in a plunge-grinding process, whereby for the sake of simplicity the opposing planar shoulder has been omitted. Since the grinding wheel is dressed such that its contour after dressing coincides with the workpiece final contour 32 to be ground, the bearing bush can be ground completely both on the circumferential area and on the planar surfaces using a single plunge-grinding process on three grinding areas simultaneously. This is possible because in particular deviations in the grinding wheel, caused on the one hand by dressing and on the other hand by wear on the grinding wheel, can be compensated by the ability to adjust the width of the grinding tool.

The area in the transition from the edge radius of the grinding wheel to the grinding surfaces/lateral surface 6C, identified by a thick line, illustrates a grinding zone 33 in which, due to the fact that the grinding tool and the workpiece are rotationally symmetrical parts, the removal of the greatest grinding amount, i.e., the amount on the planar side of the bearing bush, only has to be performed by a few of the abrasive grains. These abrasive grains in this lateral zone on the grinding tool are the most loaded during the grinding process. The abrasive grains thereafter in the radial direction of the grinding tool (that is, opposing the plunge direction into the workpiece 30) do not take part in the actual grinding process. The dressing cycles are therefore largely oriented to the wear at this location. However, since in accordance with FIG. 8*b*), with the inventive grinding tool uniform dressing can occur at the circumferential surface 6B (not shown), 6A, and 6C, the grinding wheel can be dressed like this again and again and adjusted by the dressing amount in the width such that the workpiece final contour 32 to be ground can be attained again and again. Thus the service life of the tool can be substantially increased. On the other hand, the grinding tool can be restored by dressing in the entire grinding area such that a grinding wheel that is always "sharp" and has good cutting capability results after dressing. Because of this, changes in the microstructure are avoided that otherwise might occur due to the effect of heat on the workpiece.

Figure 10:
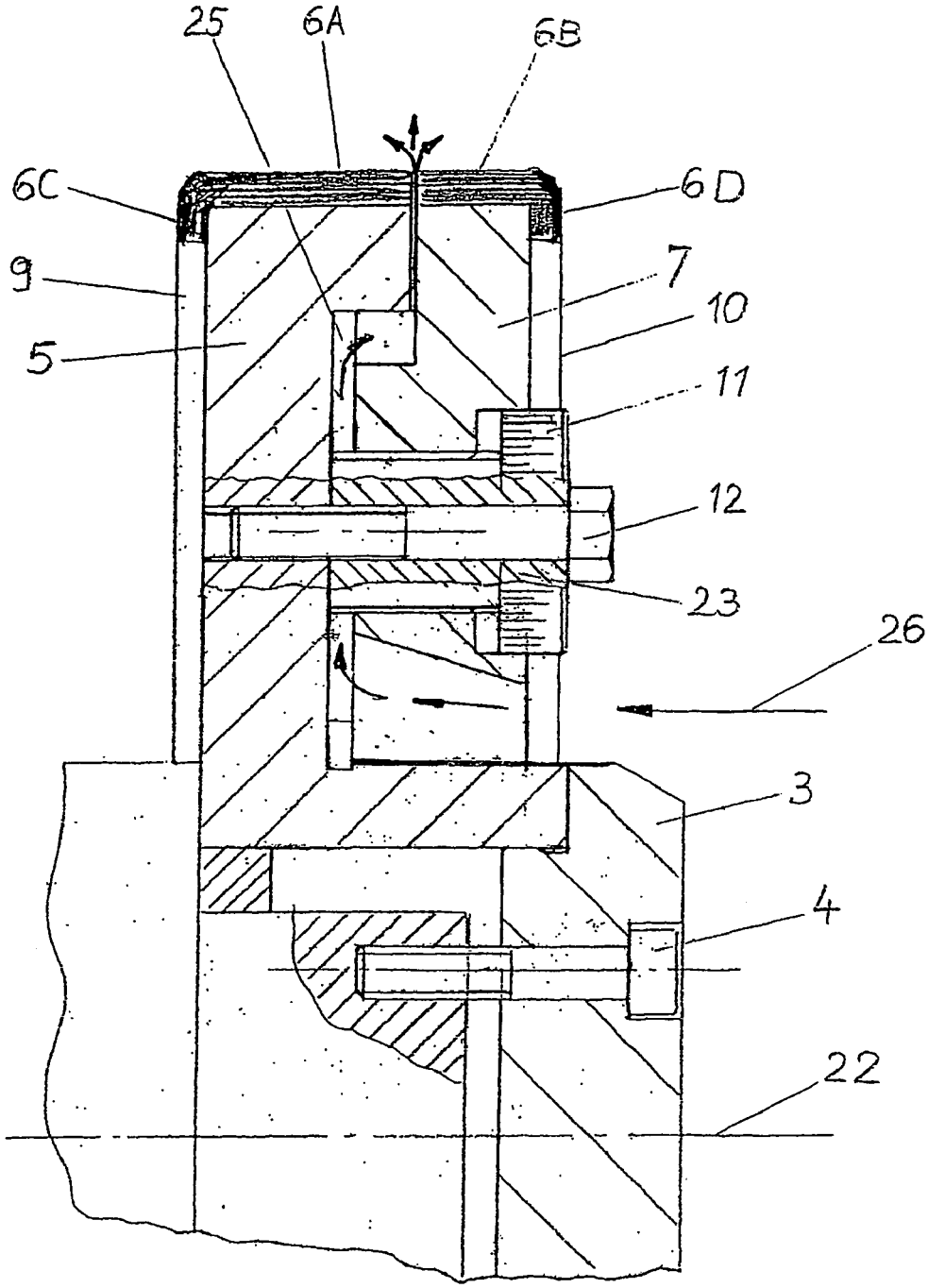

FIG. 10 illustrates a grinding tool in accordance with a further development of the invention in which a coolant 26 flows through the intermediate spaces 25 between the grinding wheel parts 5 and 7. The coolant is preferably fed in the axial direction to the grinding tool, which can preferably occur under pressure. Within the intermediate spaces 25, on the one hand due to the pressure and on the other hand due to the centrifugal force to which the coolant is subjected due to the rotation of the grinding tool, the coolant is transported outward and can thus escape the separating joint between the part 5 and the part 7 on the circumferential surface, directly in the immediate grinding area. Such a grinding tool with internal cooling can naturally also undergo external cooling so that it is possible to obtain optimum coolant supply to all of the grinding surfaces.

Another advantage of such a grinding tool with internal cooling is comprised in that, because of the permanent flow of coolant 26 the separating joints between the parts 5 and 7 are permanently cleaned and no grinding residue can collect in these separating joints.

The rest of the construction of the inventive grinding tool largely corresponds to that in accordance with FIG. 1.

LEGEND

1 Grinding tool
2 Grinding spindle
3 Mounting flange
4 Tensioning bolt
5 (Grinding tool) part
6 Grinding surfaces
6A,B Grinding surfaces, circumferential area
6C,D Grinding surfaces, lateral surfaces
7 (Grinding tool) part
8 Outer centering shoulder/centering collar
9 Outer lateral surface of grinding wheel-type body
10 Outer lateral surface of grinding wheel-type body
11 Scale for positioning mechanism
12 Setscrew for positioning mechanism
13 Threaded tensioning pin
14 Interior centering shoulder/centering collar
15 Overlap
16 Overlap
17 Circumferential line
18 Surface perpendicular to rotational axis
19 Surface perpendicular to rotational axis
20 Surface inclined to rotational axis
21 Surface inclined to rotational access
22 Rotational axis
23 Setscrew
24 Abutting surface
25 Intermediate space
26 Coolant
27 Dressing wheel
28 Diamond layer
29 Grinding wheel contour prior to dressing
30 Workpiece
31 Workpiece, raw contour
32 Workpiece, final contour
33. Grinding surface

The invention claimed is:

1. Grinding tool comprising a grinding wheel body comprised of first and second parts detachably connected to each other, said first part being securely attachable to a grinding spindle, coaxially therewith, the grinding wheel body having a circumferential grinding surface comprising circumferences of said first part and said second part coated with an abrasive material, a space being formed on the circumferential grinding surface between said first part and said second part, at least three adjusting/positioning devices arranged on said second part at substantially equal angular displacements from each other about an axis of the grinding tool for adjusting position of said second part relative to said first part and fixing said second part in the adjusted position, said devices being substantially radially spaced from said axis, an outer centering collar disposed between said first part and said second part and being radially spaced from said axis a greater distance than said devices, wherein said second part is adjustable relative to said first part in directions of said axis while maintaining the circumferential grinding surface comprising the coated circumferences of said first part and said second part equidistant from said axis thereby to adjust width of the circumferential grinding surface.

2. Grinding tool in accordance with claim 1, further comprising an inner centering collar spaced radially inward from said devices.

3. Grinding tool in accordance with claim 1 or 2, wherein the abrasive material comprises at least one of CBN or diamond.

4. Grinding tool in accordance with claim 1 or 2, further comprising threaded tensioning pins and, received on threads of each of the tensioning pins, a respective tensioning bolt for tightening the respective tensioning pin, and wherein the tensioning pins help fix said second part to said first part in a non-positive fit and without play.

5. Grinding tool in accordance with claim 1 or 2, further comprising means for centering the grinding tool on a nose of the grinding spindle.

6. Grinding tool in accordance with claim 1 or 2, further comprising measurement sensors and means for continuously actuating the adjusting/positioning devices in response to sensed measurements.

7. Grinding tool in accordance with claim 1 or 2, further comprising means for manually actuating the adjusting/positioning devices.

8. Grinding tool in accordance with claim 1 or 2, further comprising means for automatically actuating the adjusting/positioning devices.

9. Grinding tool in accordance with claim 1 or 2, further comprising a scale integral with the grinding tool for measuring the width of the circumferential grinding surface.

10. Grinding tool in accordance with claim 1 or 2, further comprising spaces formed between said first part and said second part for conducting coolant from an external source to said space formed on the circumferential grinding surface thereby the conduct coolant to sites of the grinding.

* * * * *